US005189954A

United States Patent [19]

Ono

[11] Patent Number: 5,189,954

[45] Date of Patent: Mar. 2, 1993

[54] INK SUPPLYING DEVICE FOR A PRINTING PRESS

[75] Inventor: Yoshiaki Ono, Shizuoka, Japan

[73] Assignee: Tokyo Electric Co., Ltd., Tokyo, Japan

[21] Appl. No.: 834,192

[22] Filed: Feb. 12, 1992

[30] Foreign Application Priority Data

Feb. 15, 1991 [JP] Japan ..... 3-44208

[51] Int. Cl.[5] ..... B41F 7/00; B41F 31/02

[52] U.S. Cl. ..... 101/329; 101/367

[58] Field of Search ..... 101/329, 141, 369, 331, 101/367, 348, 349; 401/197

[56] References Cited

U.S. PATENT DOCUMENTS

| | | | |
|---|---|---|---|
| 949,437 | 2/1910 | Munk | 101/367 |
| 1,448,703 | 3/1923 | Chisholm | 101/367 |
| 2,676,536 | 4/1954 | Ste-Marie | 101/141 |
| 3,427,969 | 2/1969 | Strothmann | 101/367 |
| 3,491,685 | 1/1970 | Tramposch | 101/367 |
| 4,130,056 | 12/1978 | Mabrouk et al. | 101/141 |
| 4,246,842 | 1/1981 | Williams et al. | 101/367 |
| 4,739,604 | 4/1988 | Natterer | 101/329 |
| 4,963,404 | 10/1990 | Jenkins | 101/348 |

FOREIGN PATENT DOCUMENTS

| | | | |
|---|---|---|---|
| 60-168941 | 11/1985 | Japan . | |
| 0913564 | 12/1962 | United Kingdom | 101/367 |

*Primary Examiner*—Edgar S. Burr
*Assistant Examiner*—Anthony H. Nguyen
*Attorney, Agent, or Firm*—Oblon, Spivak, McClelland, Maier & Neustadt

[57] ABSTRACT

The present invention provides an ink supplying device for a printing press provided with a master cylinder (7), including an ink supply roller (41) comprising a cylindrical core member (51) internally defining an ink chamber (53) for containing ink, a cylindrical ink-absorbing member (52) formed on the cylindrical core member. The ink-absorbing member (52) is impregnated with the ink contained in the ink chamber (53) by a capillary action. The ink is transferred from the ink-absorbing member (52) through mixing rollers (43, 44) and an inking roller (46) to a master paper (2) wound around the master cylinder (7) of the printing press in an ink film of uniform thickness.

3 Claims, 5 Drawing Sheets

INK SUPPLYING DEVICE FOR A PRINTING PRESS

FIELD OF THE INVENTION AND RELATED ART STATEMENT

The present invention relates to an ink supplying device for a printing press.

In operating a conventional offset printing press, a master paper having a printing area that accepts ink and repels water and a nonprinting area that repels ink and accepts water is wound around a master cylinder, the master paper is dampened with dampening water supplied thereto by a dampening roller, greasy ink stored in an ink fountain is supplied to the master cylinder by an inking unit including an inking roller, the ink is applied to the master paper by the inking roller, only the ink-receptive printing area is inked, the ink applied to the paper master is transferred to a blanket wound around an impression cylinder in an ink image, and then the ink image formed on the blanket cylinder is transferred to a paper sheet.

In operating such a conventional offset printing press for printing operation, greasy ink must be supplied with an ink knife from an ink container to the ink fountain of the offset printing press and the greasy ink must be leveled in the ink fountain with the ink knife so that the ink fountain roller is in contact uniformly with the ink. This ink supplying procedure must be performed before every printing operation, often smearing hands and requiring troublesome work.

OBJECT AND SUMMARY OF THE INVENTION

A first object of the present invention is to apply ink to a master paper in a uniform thickness.

A second object of the present invention is to facilitate replenishing an ink fountain with ink so that the ink can be supplied to the ink fountain without smearing hands.

A third object of the present invention is to ensure the prevention of leakage of ink from an ink container during the transportation of ink from a manufacturer to a user.

The present invention provides an ink supplying device comprising: an inking roller supported for rotation in contact with a master paper wound around a master cylinder supported for rotation; an ink mixing unit having at least one mixing roller supported in contact with the inking roller; and an ink supply roller for supplying ink to the mixing roller, supported for rotation, and having a cylindrical ink absorbing member formed of a porous material capable of being impregnated with the ink, and internally defining an ink chamber for containing ink.

A cylindrical ink sealing tube formed of an ink intercepting film is inserted in the ink absorbing cylinder so as to be axially extracted from the ink absorbing cylinder.

The ink contained in the ink chamber of the ink absorbing cylinder is diffused uniformly as the ink supply roller rotates and is absorbed by the ink absorbing member by a capillary action, the ink absorbed by the ink absorbing member is transferred through the mixing roller to the inking roller in a uniform thickness, and then the ink is transferred from the inking roller to the master paper.

In transporting the ink supply roller charged with ink, the ink sealing tube prevents the leakage of the ink from the ink chamber of the ink supply roller. In using the ink supply roller for printing, the ink sealing tube is removed from the ink absorbing member by pulling the ink sealing tube in an axial direction to enable the ink absorbing member to be impregnated with the ink.

DETAILED DESCRIPTION OF THE PREFERRED EMBODIMENTS

Figure 2:
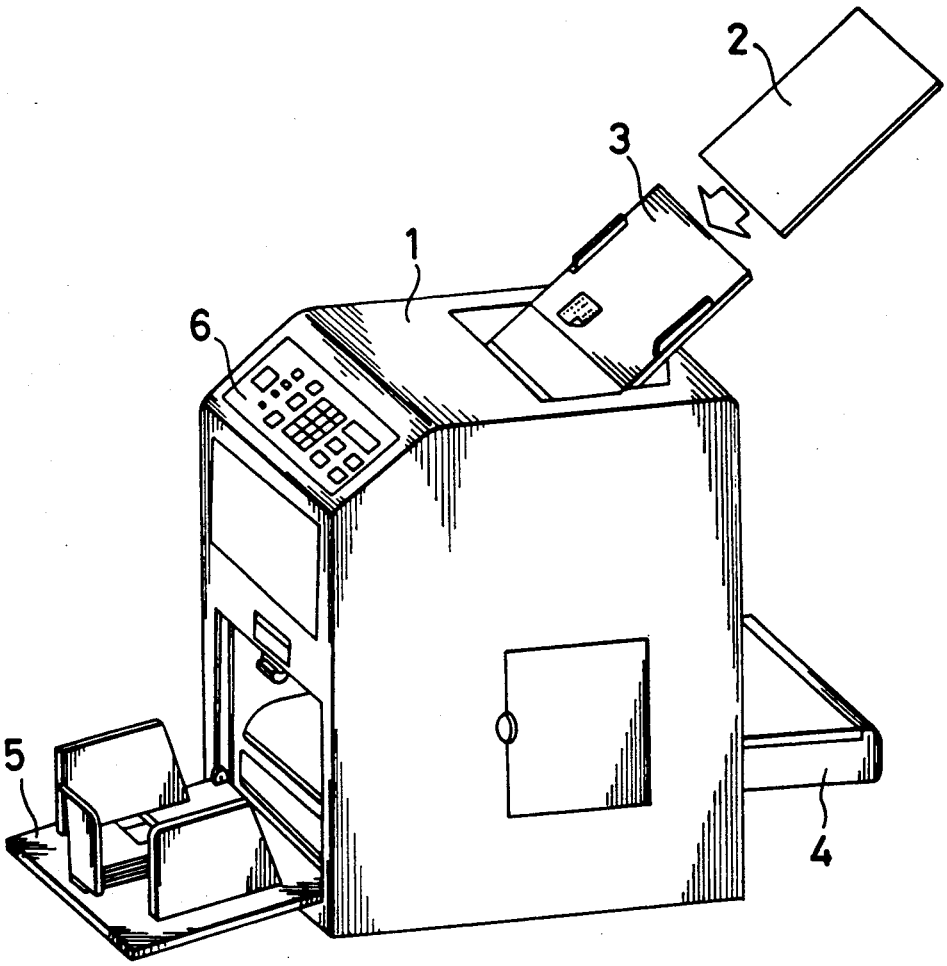
FIG. 2 is a perspective view of a printing press incorporating the ink supplying device of FIG. 1.

An ink supplying device in a first embodiment according to the present invention will be described hereinafter with reference to the accompanying drawings. Referring to FIG. 2 showing a printing press incorporating the ink supplying device, a guide 3 for guiding a master paper 2 is provided on the upper wall of a housing 1, a paper sheet cassette 4 is detachably mounted on the back side of the housing 1, and a delivery table 5 and an operating unit 6 are provided on the front side of the housing 1.

Figure 1:
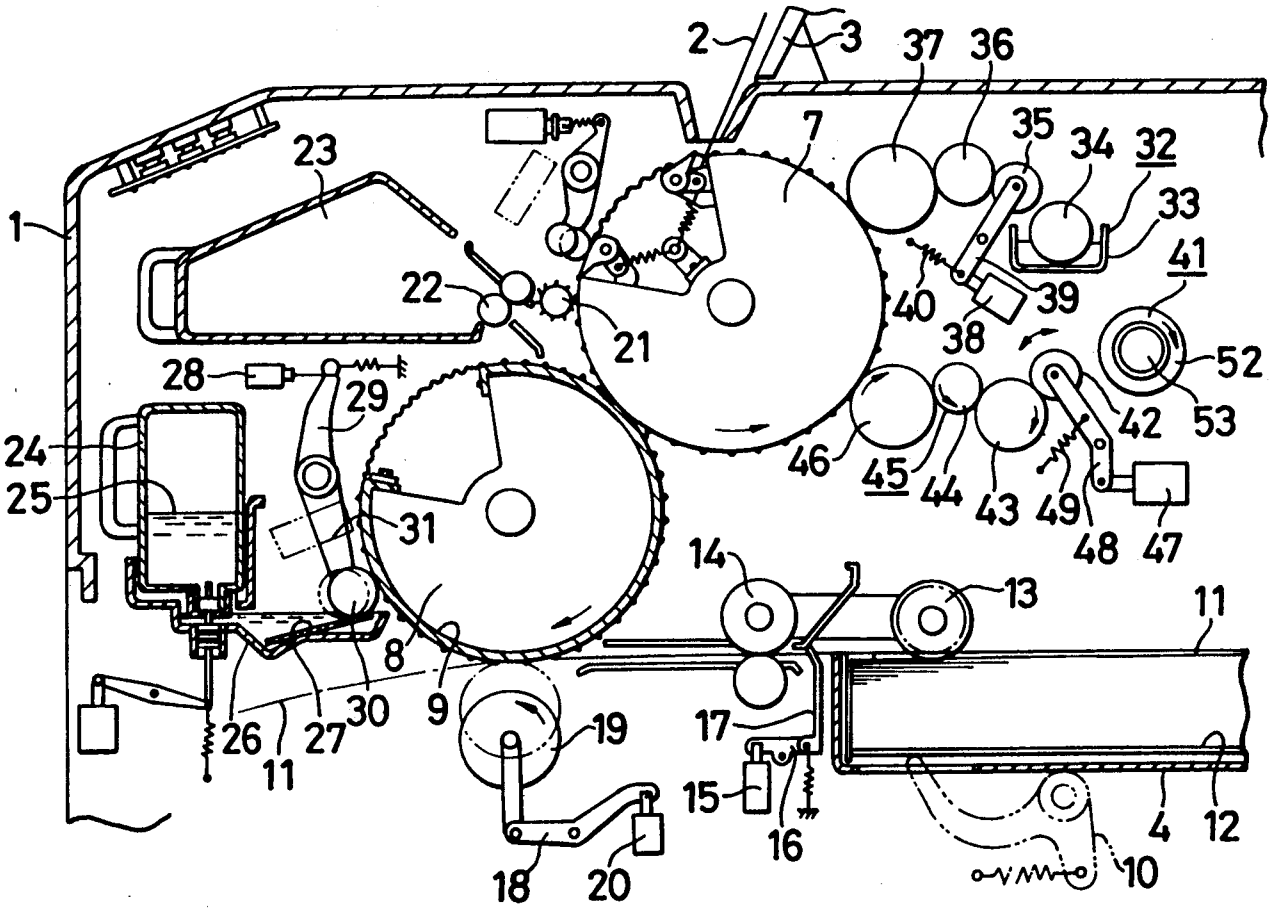
FIG. 1 is a partly sectional front view of an ink supplying device in a first embodiment according to the present invention.

As shown in FIG. 1, a master cylinder 7 on which is wound the master paper 2, and an impression cylinder 8 are supported for rotation within the housing 1. The master cylinder 7 and the impression cylinder 8 are driven for rotation by a motor. The circumference of the impression cylinder is coated with a rubber blanket 9.

Paper sheet cassette 4 has a support plate 12 supporting a stack of paper sheets 11, and a lifting member 10 for lifting up the support plate 12. The top paper sheet 11 pulled out from the paper sheet cassette 4 by a pickup roller 13 is transported to a position under the impression cylinder 8 by a transport roller 14. A buckle plate 17 for aligning the front edges of the paper sheets 11 is disposed between the pickup roller 13 and the transport roller 14. The buckle plate 17 is operated by a solenoid actuator 15. A lever 18 pivotally supported within the housing 1 has one end joined to a support rotatably supporting a pressure roller 19 opposite to the lower portion of the impression cylinder 8 and the other end joined to the plunger of a solenoid actuator 20. A stripping roller 21 is disposed near the master cylinder 7 and is supported for rotation. A void case 23 is disposed near the stripping roller 21. A delivery roller 22 is disposed near the stripping roller 21 at the inlet of the void case 23. A cleaner pan 26 for receiving a cleaning liquid 25 let fall in drops from a cleaner tank 24 is disposed under the void case 23. An absorptive cleaner pad 27, such as a sponge pad, is placed in the cleaner pan 26. A lever 29 pivotally supported above the cleaner pan 26 has an upper end connected to the plunger of a solenoid actuator 28 and a lower end rotatably holding a cleaning roller 30 in contact with the cleaner pad 27 and the impression cylinder 8. Indicated at 31 is a blower.

A dampening water supply unit 32 is disposed near the master cylinder 7. The dampening water supply unit 32 comprises a water pan 33 containing dampening water, a water supply roller 34 immersed in the dampening water contained in the water pan 33, a water ductor roller 35, a traverse roller 36 and a dampening roller 37. The dampening water is supplied through the water supply roller 34, the water ductor roller 35, the traverse roller 36 and the dampening roller 37 to the master paper 2 placed on the master cylinder 7. The water ductor roller 35 is supported rotatably on one end of a lever 39. The other end of the lever 39 is connected to the plunger of a solenoid actuator 38. The lever 39 is biased counterclockwise by a spring 40.

An ink supply roller 41, an ink ductor roller 42, an ink mixing unit 45 comprising two mixing rollers 43 and 44 held in contact with each other, and an inking roller 46 in contact with the mixing roller 44 and the master cylinder 7 are arranged under the dampening water supply unit 32. The ink ductor roller 42 is supported rotatably on one end of a lever 48. The other end of the lever 48 is connected to the plunger of a solenoid actuator 47. The lever 48 is biased counterclockwise by a spring 49.

Figure 3:
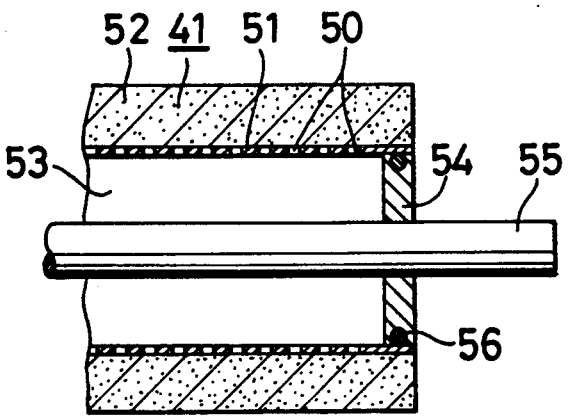
FIG. 3 is a fragmentary longitudinal sectional view of an ink supply roller included in the ink supplying device of FIG. 1.
Figure 4:
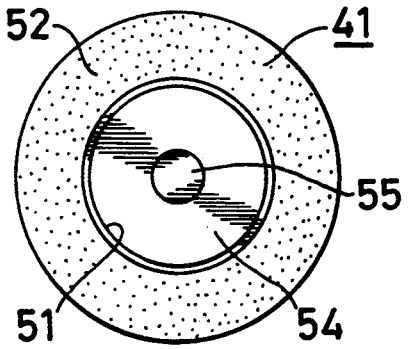
FIG. 4 is a front view of the ink supply roller.
Figure 9:
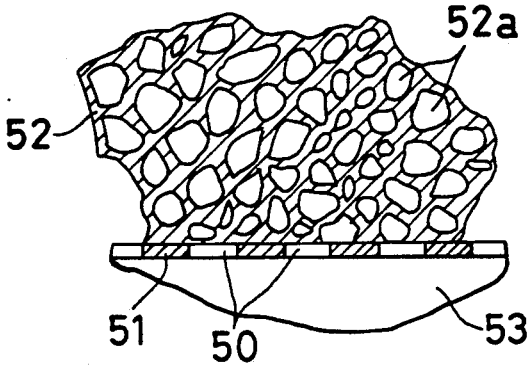
FIG. 9 is an enlarged, fragmentary longitudinal sectional view of the ink supply roller.

Referring to FIGS. 3 and 4, the ink supply roller 41 comprises a cylindrical core member 51 having many radial pores 50 and defining an ink chamber 53, a cylindrical ink absorbing member 52 fixedly fitted on the core member 51, end plates 54 fitted respectively in the opposite ends of the core member 51 with O rings 56 therebetween, and a shaft 55 fixed to the end plates 54. As shown in an enlarged view in FIG. 9, the ink absorbing member 52 is formed of a porous material having many voids 52*a*. Although the voids 52*a* look like individual voids in FIG. 9, actually, the adjacent voids 52*a* communicate with each other. The ink contained in the ink chamber 53 oozes through the pores 50 of the core member 51 and is conveyed through the voids 52*a* of the ink absorbing member 52 to the circumference of the ink absorbing member 52 by a capillary action. The ink is a nondrying offset printing ink having a viscosity in the range of tens to hundreds poise. The ink absorbing member 52 may be of a single-layer construction or of a two-layer construction consisting of an outer layer having a lower porosity and an inner layer having a higher porosity. The material forming the ink absorbing member is a continuous foam material.

Figure 5:
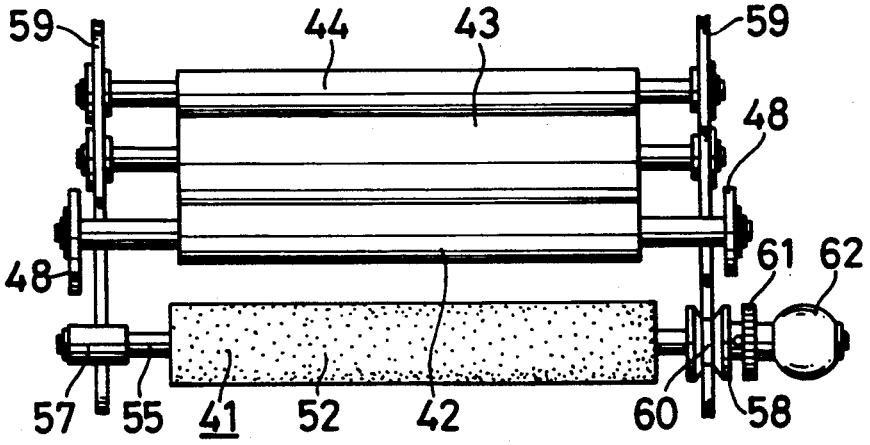
FIG. 5 is a plan view of a supporting structure for supporting the ink supply roller and mixing rollers.

Referring to FIG. 5, the shaft of the ink supply roller 41 is supported at its opposite ends in bearings 57 and 58 held on opposite side places 59. The mixing rollers 43 and 44 are journaled also on the side places 59. The bearing 58 is provided with an annular groove 60 having a V-shaped cross section in its outer circumference so as to receive the side plate 59 therein. A gear 61 to be driven through a gear train by a motor, and a knob 62 are fixed to one end of the shaft 55 of the ink supply roller 41.

Figure 6:
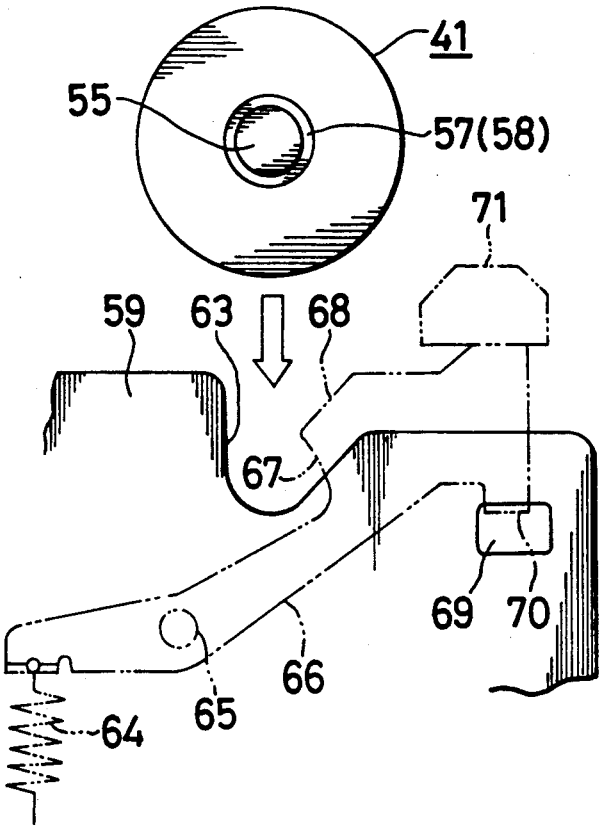
FIG. 6 is a front view of assistance in explaining a manner of mounting the ink supply roller on a side plate.
Figure 7:
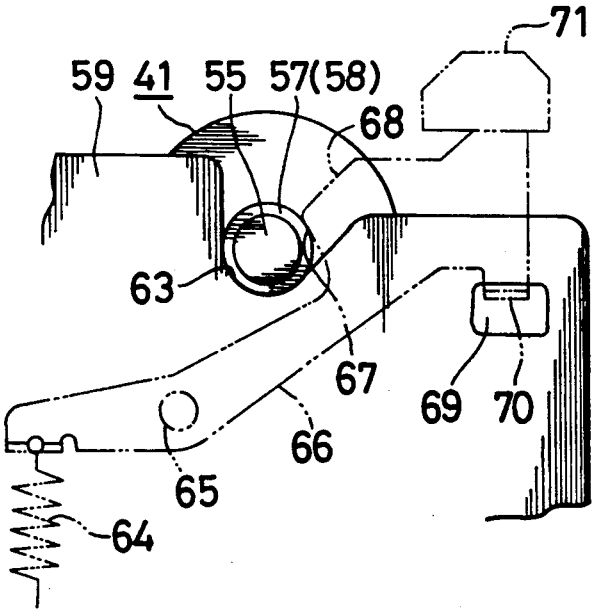
FIG. 7 is a front view of the ink supply roller mounted on the side plate.
Figure 8:
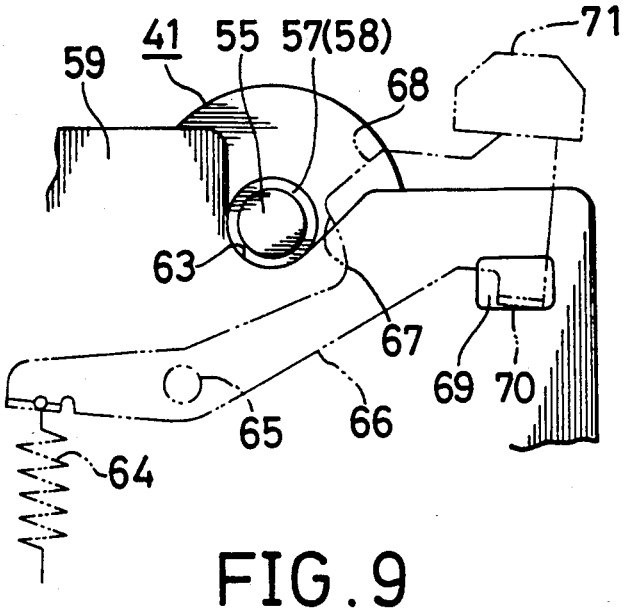
FIG. 8 is a front view of assistance in explaining a manner of removing the ink supply roller from the side plate.

As shown in FIGS. 6, 7 and 8, recesses 63 opening upward to receive the bearings 57 and 58 are formed in the upper edges of the side places 59, respectively, and holding levers 66 are supported pivotally on a shaft 65 fixed to the side places 59, respectively. The holding levers 66 are biased counterclockwise, as viewed in FIGS. 6 to 8, by springs 64 so as to press the bearings 57 and 58 against the bottoms of the recesses 63, respectively. Each of the holding levers 66 has an inclined surface 67 facing down so as to press the bearing 57 (58) against the bottom of the corresponding recess 63, a bend 70 projecting into an opening 69 formed in the side plate 59, and an upper end fixedly provided with a push button 71.

The dampening water supplied by the dampening water supply unit 32 to the master paper 2 wound around the master cylinder 7 is repelled by the printing area of the master paper 2 and dampens the nonprinting area of the same. The ink contained in the ink chamber 53 of the ink supply roller 41 is dispensed uniformly as the ink supply roller 41 rotates, flows through the pores 50 of the core member 51, and is absorbed by the ink absorbing member 52. The ink thus absorbed by the ink absorbing member 52 is transferred to the mixing roller 43 by the ink ductor roller 42 and is mixed by the mixing rollers 43 and 44. Then, the mixed ink is transferred from the mixing roller 44 to the inking roller 46 to form an ink film of a uniform thickness over the circumference of the inking roller 46, and then the ink is transferred to the master paper 2 wound around the master cylinder 2. The ink is accepted by the printing area of the master paper 2 and is repelled by the nonprinting area of the same. Then, the ink adhering to the printing area of the master paper 2 is transferred to the blanket 9 covering the impression cylinder 8 in an ink image corresponding to the printing area of the master paper 2. The ink image is transferred from the blanket 9 to the paper sheet 11 fed from the paper sheet cassette 4 and held between the impression cylinder 8 and the pressure roller 19. Then, the paper sheet 11 is separated from the blanket 9 and the ink image is dried by air blown by the blower 31. The ink remaining on the blanket 9 is wiped off by the cleaning roller 30. Prior to starting the printing operation, the operating unit 6 is operated to specify the number of copies to be printed. After the specified number of copies have been printed, the stripping roller 21 separates the master paper 2 from the master cylinder 7, and the delivery roller 22 delivers the master paper 2 into the void case 23.

As shown in FIG. 8, the holding levers 66 are turned clockwise, as viewed in FIG. 8, by applying a pressure F to the push buttons 71 to retract the inclined surfaces 67 from the bearings 57 and 58, and then the ink supply roller 41 is removed in an upward direction from the side places 59. Then, the holding lever 66 are turned counterclockwise by the springs 64 to a position shown in FIG. 6. The counterclockwise turning of the holding levers 66 is limited by the engagement of the bends 70 with the upper edges of the corresponding openings 69. Accordingly, in mounting the ink supply roller 41 again on the side places 59, the bearings 57 and 58 are put on the upper inclined surfaces 68 of the holding levers 66, and the ink supply roller 41 is pushed down by hand to turn the holding levers 66 clockwise so that the bearings 57 and 58 are able to drop into the recesses 63. Then, the holding levers 66 are turned counterclockwise by the springs 64 to hold the bearings 57 and 58 on the bottoms of the recesses 63, respectively.

Figure 10:
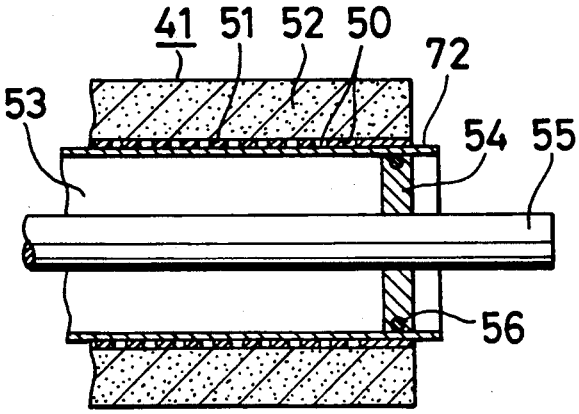
FIG. 10 is a fragmentary longitudinal sectional view of an ink supply roller employed in an ink supplying device in a second embodiment according to the present invention.

An ink supplying device in a second embodiment according to the present invention will be described hereinafter with reference to FIG. 10, in which parts like or corresponding to those of the ink supplying device in the first embodiment are denoted by the same reference characters and the description thereof will be omitted.

An ink supply roller 41 is provided with a cylindrical ink sealing tube 72 formed of a synthetic resin film. The ink sealing tube 72 is fitted in a cylindrical core member 51 defining an ink chamber 53 and fitted in an ink absorbing member 52 of the ink supply roller 41, defining an ink chamber 53 so as to be extracted axially from the cylindrical core member 51. The ink sealing tube 72 prevents the leakage of the ink contained in the ink chamber 53 during the transportation and storage of the ink supply roller 41. Prior to mounting the ink supply roller 41 on the printing press, the ink sealing tube 72 is extracted axially from the cylindrical core member 51 to enable the ink absorbing member 52 to be impregnated with the ink contained in the ink chamber 53.

The precharged ink supply roller, namely, an ink supply roller charged with the ink before shipping from the manufacturer, must be provided with the ink sealing tube. If the ink supply roller and the ink are transported separately and the ink supply roller is charged with the ink at the place of use, the ink supply roller need not necessarily be provided with the ink sealing tube.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. An ink supply roller for a printing press comprising:

a cylindrical core member defining an ink chamber therein, said cylindrical core member having a plurality of holes to allow ink to pass from the ink chamber and through said cylindrical core member;

an ink absorbing cylindrical member disposed about said cylindrical core member; and a removable cylindrical sealing tube disposed interiorly of said cylindrical core member and removably mounted such that when said cylindrical sealing tube is disposed interiorly of said cylindrical core member, ink is prevented from passing through said holes to the ink absorbing member while allowing ink to pass to said ink absorbing cylindrical member when said removable cylindrical sealing tube is removed.

2. The ink supply roller of claim 1, further including a pair of end plates provided for sealing first and second ends of said cylindrical core member, said end plates each including an O-ring seal such that a seal is provided between said end plates and said removable cylindrical sealing tube when said removable cylindrical sealing tube is disposed interiorly of said cylindrical core member, and wherein said O-rings provide a seal between said end plates and said cylindrical core member when said cylindrical sealing tube is removed.

3. An ink supplying device for a printing press comprising:

an ink supply roller having a cylindrical core defining an ink chamber therein, said cylindrical core member having a plurality of holes to allow ink to pass from the ink chamber and through said cylindrical core member, said ink supply roller further including an ink absorbing cylindrical member disposed about said cylindrical core member;

a removable cylindrical sealing tube disposed interiorly of said cylindrical core member, and removably mounted such that when said cylindrical sealing tube is disposed interiorly of said cylindrical core member, ink is prevented from passing through said holes to the ink absorbing member while allowing ink to pass to said ink absorbing cylindrical member when said removable cylindrical sealing tube is removed.

a ductor roller for receiving ink from said ink supply roller;

a first ink mixing roller which is selectively in contact with said ductor roller for receiving ink directly from said ductor roller;

a second ink mixing roller rotatably supported in contact with said first ink mixing roller such that said first and second ink mixing rollers mix ink received from said ductor roller;

an inking roller rotatably supported in contact with said second mixing roller; and a master cylinder around which a master paper is wound, wherein said inking roller is rotatably supported in contact with said master cylinder.

* * * * *